United States Patent [19]

Pass et al.

[11] Patent Number: 4,648,681

[45] Date of Patent: Mar. 10, 1987

[54] FILTERED ELECTRICAL PLUG

[75] Inventors: Raymond V. Pass, Camp Hill; James L. Schroeder, III, Palmyra; Reuben E. Ney, Mount Joy, all of Pa.

[73] Assignee: AMP Incorporated, Harrisburg, Pa.

[21] Appl. No.: 856,429

[22] Filed: Apr. 21, 1986

Related U.S. Application Data

[63] Continuation of Ser. No. 684,229, Dec. 20, 1984, abandoned.

[51] Int. Cl.[4] ..... H01R 33/945

[52] U.S. Cl. ..... 339/147 R; 333/185; 29/854

[58] Field of Search ..... 228/56.3, 246; 333/181–185; 339/143 R, 147 R, 147 P, 217 S, 275 R, 275 B; 29/854

[56] References Cited

U.S. PATENT DOCUMENTS

| | | | |
|---|---|---|---|
| 3,496,629 | 2/1970 | Martucci et al. | 228/246 |
| 3,569,915 | 3/1971 | Sorensen et al. | 339/143 R |
| 3,825,874 | 7/1974 | Peverill | 339/143 R |
| 3,854,107 | 12/1974 | Tuchto et al. | 339/147 R |
| 3,901,574 | 8/1975 | Paullus et al. | 339/90 R |
| 3,961,294 | 6/1976 | Hollyday | 333/79 |
| 4,001,490 | 1/1977 | Lynch | 339/275 R |
| 4,029,386 | 6/1977 | Krantz, Jr. et al. | 339/143 R |
| 4,083,022 | 4/1978 | Nijman | 333/79 |
| 4,126,370 | 11/1978 | Nijman | 339/143 R |
| 4,142,768 | 3/1979 | Pittman et al. | 339/217 S |
| 4,215,326 | 7/1980 | Hollyday | 339/147 R |
| 4,239,321 | 12/1980 | Bauer | 339/217 S |
| 4,265,506 | 5/1981 | Hollyday | 339/147 R |
| 4,275,945 | 6/1981 | Krantz et al. | 339/147 R |
| 4,519,665 | 5/1985 | Althouse et al. | 339/147 R |

FOREIGN PATENT DOCUMENTS

| | | | |
|---|---|---|---|
| 0118168 | 9/1984 | European Pat. Off. | 339/143 R |

*Primary Examiner*—Gil Weidenfeld
*Assistant Examiner*—Gary F. Paumen
*Attorney, Agent, or Firm*—Katherine A. Nelson

[57] ABSTRACT

A pin connector has a pin carrier into which a plurality of contact pins snap in and are retained; the pin carrier being cemented in an outer conductive shell having a plurality of hollow tubular filter member with each pin having a part thereof seated in a different one of the tubular members and the outer diameter of the tubular filter members are grounded whereby to provide a low pass filter in the body for each pin. A front pin guide is inserted in the end of the shell opposite the pin carrier, all members being aligned by means of a key in the interior surface of the shell and keywrap in all of the interior inserts.

14 Claims, 4 Drawing Figures

FILTERED ELECTRICAL PLUG

This application is a continuation of application Ser. No. 684,229, filed Dec. 20, 1984, now abandoned.

RELATED APPLICATIONS

This application is related to U.S. patent application Ser. No. 683,846 filed on concurrent date by Raymond V. Pass and Patrick F. Yeager entitled "Filtered Electrical Receptacles" and assigned to the same assignee as the present invention.

BACKGROUND OF THE INVENTION

The present invention relates to multiple pin connectors and more specifically to connectors having integral therewith bidirectional interference filters installed in mating plugs and sockets.

Multiple pin connectors of the type to which the present invention relates are used primarily in instruments, computers and the like that are enclosed in a case. The connectors have one member, the pin receptacle, mounted in the cabinet and contact is made with a cable through the other member of the connector, that is, the pin connector. In order to prevent electrical interference passing through the connector, the connector members are provided with tubular filter sleeves connected between each pin and ground to provide a low pass filter and thereby eliminate interference problems.

The filter connectors are difficult to produce and assemble and often do not insure good grounding of the tubular filter sleeves; a good strong interconnection between the cable braid and the connector housing is also an essential feature of a successful filter.

BRIEF DESCRIPTION OF THE PRESENT INVENTION

The present invention provides an easily assembled, economical multiple pin connector with interference filters extending between each pin and ground. The connector consists of an outer shell having tubular filter sleeve elements mounted therein, a pin housing, a ferrule for holding one end of the cable relative the connector, pin contacts seated in the pin housing and in contact inside of said tubular elements, an end member to position the pins near their contact ends and an outer guard. The pins are provided with spring fingers and lugs for engaging the edges of a shoulder in the pin housing so that the pins snap into place by insertion in the housing catching the edges of the shoulder between the spring fingers and the lugs. The pins are also positioned such to have a plurality of spring elements seated in each of the tubular members and in contact therewith.

To assemble the apparatus, the tubular elements are positioned each in a separate hollow cylindrical hole in a transverse wall in the outer shell and are soldered in place by use of a solder form and heat, the solder electrically connecting the tubular elements to shell. Each pin is connected to a separate lead of a cable and then inserted in the pin housing and locked in place. The pin housing is inserted into one end of the outer shield with the pins passing through the tubular elements and contacting them via spring fingers. The end pin support is inserted in the other end of the shell and the various elements are glued or otherwise secured in the outer shell as appropriate. Each of the solder plate, pin housing and end plate have keyways which cooperate with a key along the inner diameter of the shell to insure proper alignment of all elements. The cable braid, if the cable is braided, is applied over an end of the ferrule which is in contact with the shell. The assembly is enclosed within a rubberized plastic for support and color matching considerations.

The above assembly is simple and quick, the most complex part being the pins and those are of relatively simple construction. The outer shell is a die cast sleeve with an apertured transverse wall and the pin housing is a barrel of a plurality of elongated circular holes. An important feature is that the construction in large quantities readily lends itself to automated assembly.

DETAILED DESCRIPTION OF THE INVENTION

Figure 1:
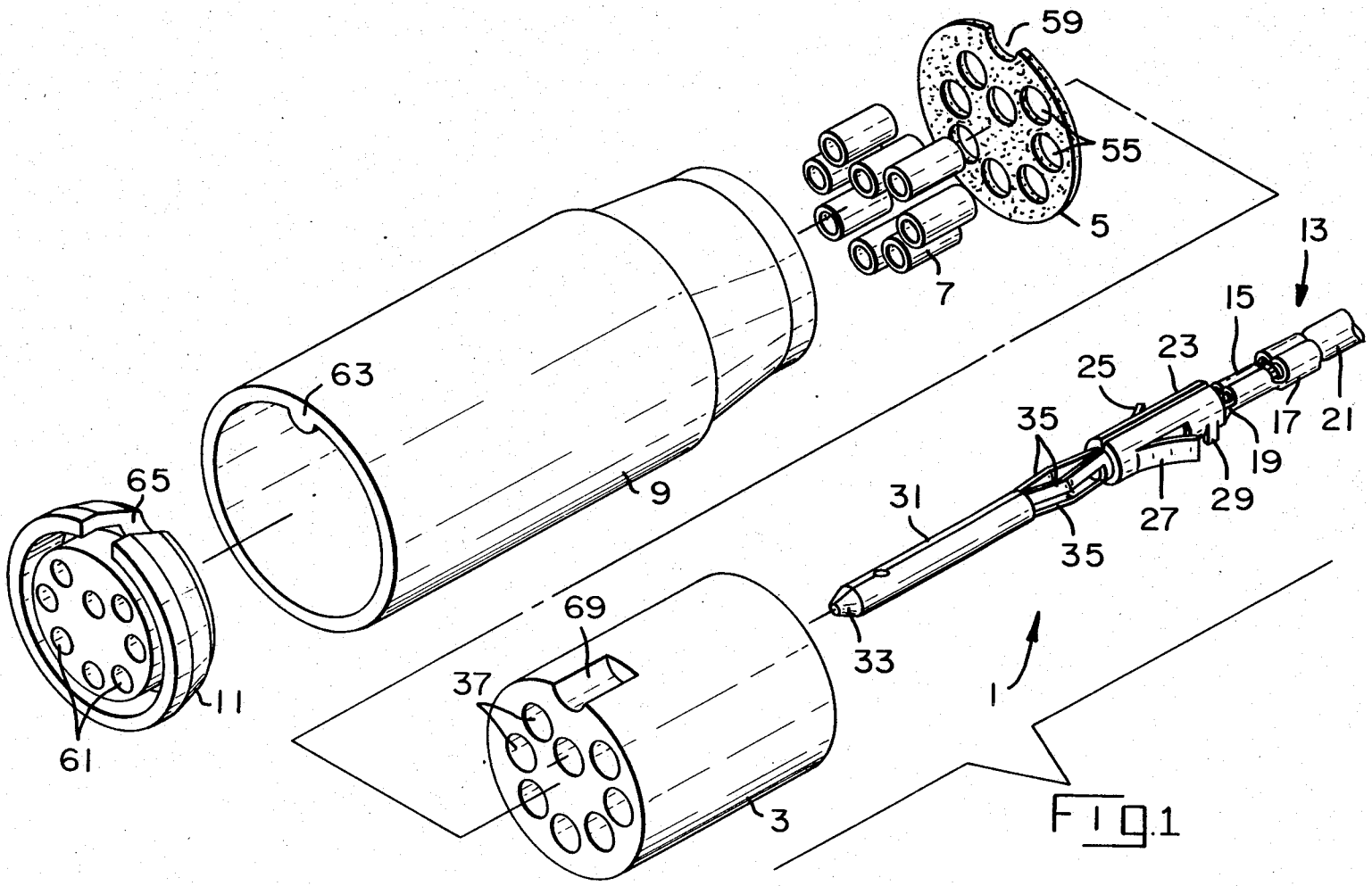
FIG. 1 is an expanded view showing all of the elements disassembled but positioned in the order of assembly.

Referring now specifically to FIG. 1 of the accompanying drawings the major elements of the pin connector are illustrated in exploded view. The elements are contact pins 1 (only one illustrated), pin housing 3, solder disk 5, insulating hollow tubular members 7 having conductive coating on their inner and outer circumferential surfaces constituting the filter elements, outer shell 9 and an end member pin support referred to as the front insert 11.

The contact pin 1 constitutes a wire clamping end 13 having formable pairs of fingers 15 and 17 for crimping the stripped end 19 of a single wire 21 of a cable (not illustrated in FIG. 1). Fingers 17 clamp the insulation of the wire 21 whereby the pin 1 is secured to the wire in conventional fashion. The end 13 of the pin connector 1 connects with a split barrel section having diametrically opposed outwardly extending curved spring fingers 25 and 27, the outermost ends of the spring fingers 25 and 27 extending toward the end 13 of the pin. Located between the end 13 and the fingers 25 and 27 are lugs 29 (only one illustrated) extending out from the barrel 23 generally in line with the fingers 25 and 27. It is to be understood that the wire can be terminated to the contact pins by other means such as soldering or insulation displacement.

The pin 1 terminates in a contact region 31 comprising an elongated split cylinder terminating in a tapered alignment region 33. Extending between the region 31 and the barrel 23 are at least three outwardly bowed spring members 35 looking generally like a Japanese lantern. The entire pin is stamped and formed from a single piece of metal.

Figure 2:
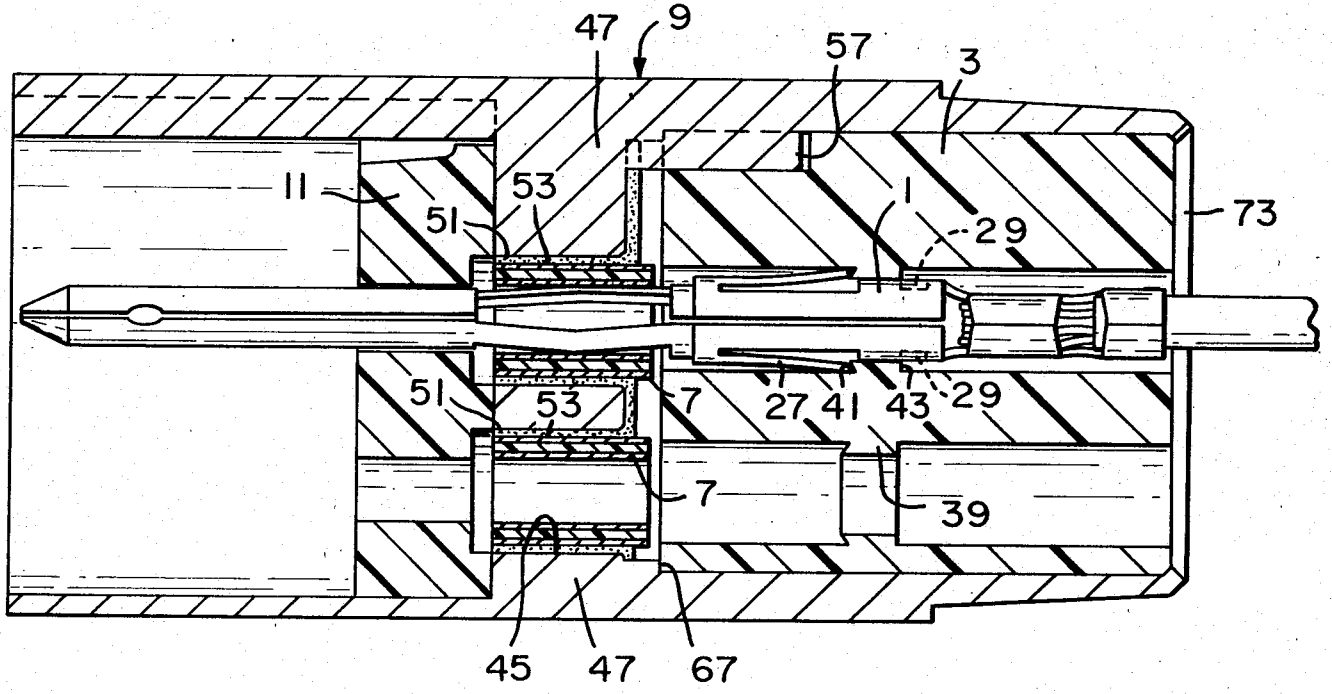
FIG. 2 is a sectional view illustrating the assembly of the main components of the invention.

The pin 1 is adapted to be inserted in one of a plurality of circular passages or bores 37 in pin housing 3, there being one such passage 37 for each pin. The number of pins may vary from three to eight or more depending upon the use to which the connector is to be put. Referring specifically to FIG. 2 of the accompanying drawings, the interior of each bore 37 provides an inwardly directed shoulder 39 providing radial walls 41 and 43 spaced apart by the distance between spring fingers 25 and 27 and lugs 29 on the barrel 23. The diameter of the bore 37 to the left of shoulder 39 as viewed in FIG. 2 of the accompanying drawings, is of a diameter to maintain the fingers 25 and 27 in a somewhat compressed state.

Upon insertion of the pin 1 in a bore 37, the fingers 25 and 27 snap outward when pushed beyond the shoulder 39 and the shoulder is clamped between the fingers 25 and 27 and the studs 29, whereby the pin is locked in the bore.

Referrng now to FIGS. 1 and 2, each of the tubular filter members 7 is inserted in a different bore 45 in a transverse wall 47 in the shell 9. The tubular filter members 7 may be tubular capacitor members of the standard type or preferably be of the type such as those disclosed in U.S. Pat. No. Re. 29,258, the disclosure of which is incorporated herein. The tubular members 7 are longer than the length of the bores 45 and extend outwardly from the bores toward the right as illustrated in FIG. 2 and are positioned flush with the left surface of the wall 47. The tubular members 7 have a slightly smaller outside diameter than the diameter of the bores 45. The tubular members are located along the axis of the bores and a narrow space 53 is provided into which solder can flow to provide one plate of a capacitor. The solder plate 5 is provided with circular apertures 55 having the same geometric pattern as the bores 45 with the diameter of the circular apertures about equal to the outside diameters of the tubular members 7. The solder plate 5 is inserted into the interior of the shell 9 and slid over the ends of the tubular members extending outwardly from the wall 47. To assist in alignment of the solder plate 5 with the tubular members, and reference is made to FIG. 2, a key 57 extends radially inward from the circumferential interior wall of the shell 9. The plate 5 has a keyway or notch 59 located in its outer periphery such that when the key and keyway are aligned, the apertures 55 are aligned with the members 7.

With the tubular members 7 located in the shell 9, the solder plate 5 is slid into position over the ends of the tubular member 7 and is abutted against the right radial surface of the wall 47. The shell is now heated to cause the solder to melt and flow into the spaces 53 providing a good ground to the wall 47 for the plates of the filter sleeves formed in the spaces 53.

The front insert 11 having a plurality of bores 61 for receiving pins 1 may now be inserted into the left end of the shell as viewed in FIGS. 1 and 2. A key 63 in the shell and a keyway 65 in the insert are provided to align the bores 61 in the insert with the pins 1. The pin housing 3 is now inserted into the shell 9 with the pins passing through the tubular members and the bores 61 of the front insert 11, an annular skirt 67 extending axially from the wall 47 providing a stop for the pin housing. Alignment of the pin housing 3 and the tubular members is again achieved by a keyway 69 in the housing 3 and the key 57 in the shell. It should be noted that the structure is dimensioned such that the spring fingers 35 of each pin 1 are located inside of and in contact with the interior wall of a different tubular member 7 whereby to provide the other filter sleeve contact. The pin housing 3 is secured in place by forming a lip 73 at the rear end of shell 9. The front insert 11 is retained in place by an interference fit between its outer diameter and the inner diameter of the shell 9. It should be noted that the key 63 also provides the guide for mating with the connector receptacle of the aforesaid concurrently filed application.

Figure 3:
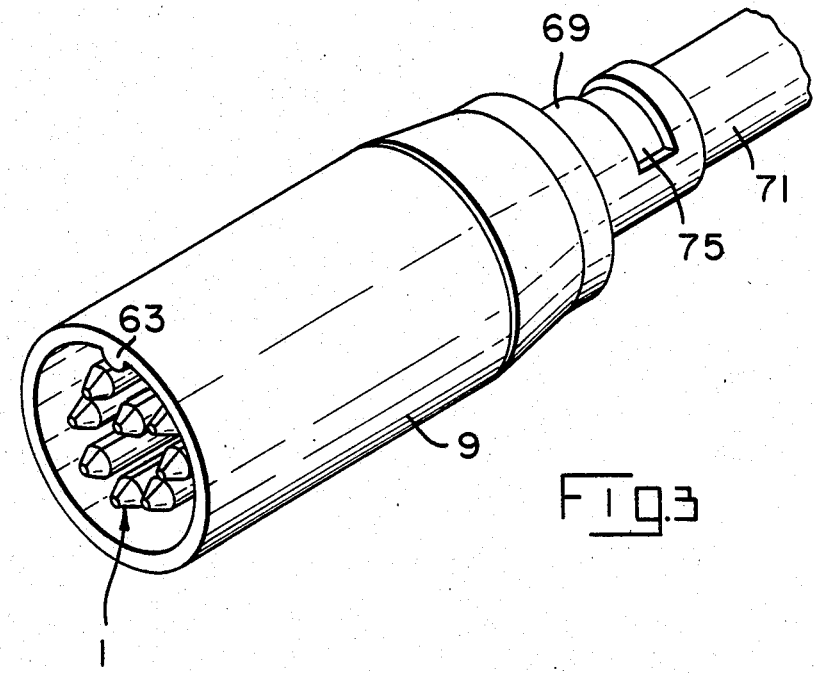
FIG. 3 is an exterior view of the assembled element without the rubber shield.
Figure 4:
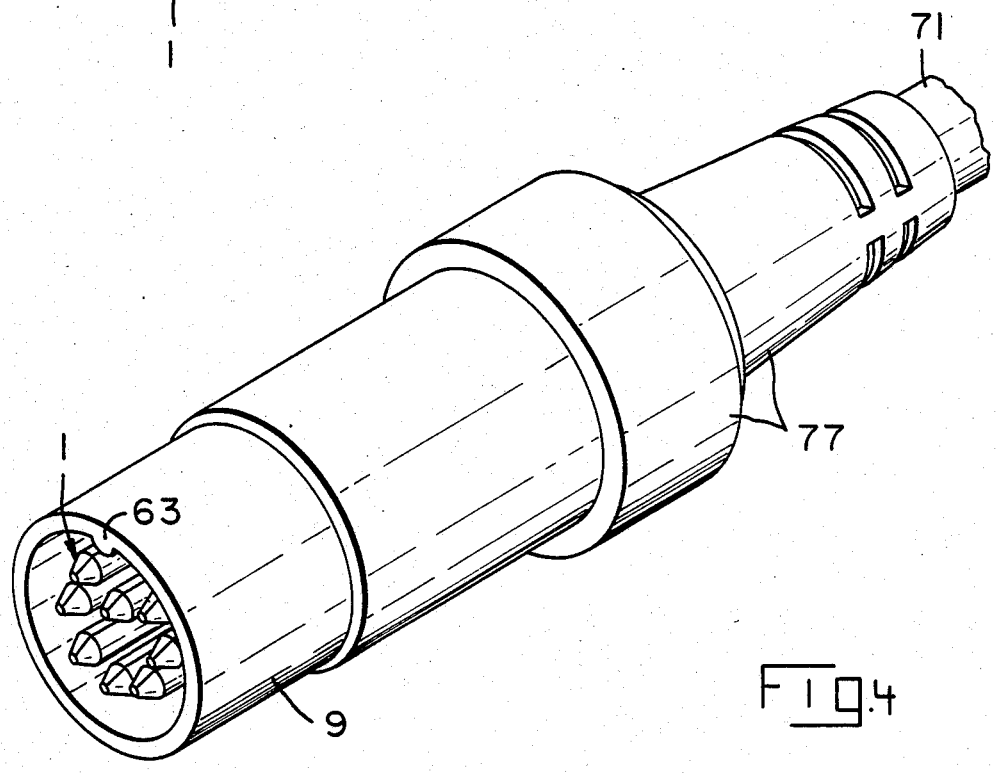
FIG. 4 is an exterior view of the fully assembled structure.

To complete the structure reference is made to FIG. 3 of the drawings, a ferrule 69 is applied to the cable of which the wire 21 forms one lead; the cable being designated by reference number 71. The ferrule is applied over the cable before the structure contacts 1 are crimped to the individual leads. After properly crimping, the contacts 1 are inserted into the assigned bores 37 of pin housing 3. Assembly is then completed by forcing ferrule 69 over the rear of shell 9 and crimping ferrule 69 to the cable jacket. Cable ground is maintained by including either a cable braid or ground lead between ferrule 69 and shell 9. The ferrule is utilized to provide support for and relieve strain in the cable where it attaches to the connector. The assembly is normally covered with a rubberized plastic sleeve 77 for additional cable support and color matching. This member is preferably molded over the assembly in a separate operation.

It is seen that the present invention provides a connector that is easily assembled, economical, strong and provides the desired filtering action.

Other improvements, modifications and embodiments will become apparent to one of ordinary skill in the art upon review of this disclosure. Such improvements, modifications, and embodiments are considered to be within the scope of this invention as defined by the following claims:

We claim:

1. An electrical connector for connection with a complementary electrical connector, comprising:

a conductive shell member having a unitary conductive transverse wall, said wall having a plurality of first passageways extending axially therethrough;

a first dielectric housing member having a plurality of second passageways therein, said first dielectric housing member being disposed within said conductive shell member on one side of said conductive transverse wall such that said second passageways of said first dielectric housing member are in alignment with a first end of said first passageways in said conductive transverse wall;

a second dielectric housing member having a plurality of third passageways therein, said second dielectric housing member being disposed within said conductive shell member on another side of said conductive transverse wall such that said third passageways are in alignment with a second end of said first passageways in said conductive transverse wall;

filter means secured in said first passageways of said conductive transverse wall and being electrically coupled thereto so as to define a grounding means;

electrical terminal means having a contact section; a filter engaging section and a conductor securing section, said electrical terminal means being positioned respectively in the aligned passageways with said filter engaging section being disposed along said filter means in electrical engagement therewith;

first and second dielectric housing retention means for retaining said dielectric housing members in said conductive member; and means provided by said first dielectric housing member for retaining said terminal means in said connector.

2. The electrical connector as described in claim 1 wherein said filter means are disposed along a substantial length of and secured in said first passageways of said conductive transverse wall.

3. The electrical connector as described in claim 1 further comprising polarizing means.

4. The electrical connector as described in claim 1 wherein said filter means is comprised of a tubular filter sleeve element disposed on said filter receiving portion of said electrical terminal means such that said filter means is positioned essentially within said first terminal-receiving passageways of said conductive shell member.

5. The electrical connector as described in claim 1 wherein said electrical terminal means is a plurality of pin terminals, the filter receiving section of each said pin terminal being of a plurality of outwardly bowed spring elements for engaging said filter means.

6. The electrical connector as described in claim 5 wherein said filter means is comprised of a tubular filter sleeve element disposed over said outwardly bowed spring elements on each said pin terminal, said filter means being positioned within said first terminal-receiving passageways of said conductive shell member.

7. The electrical connector as described in claim 5 wherein said pin terminals are further provided with outwardly extending spring finger members which cooperate with said terminal retaining means of said first dielectric housing member to lock said terminal in said connector.

8. The electrical connector as described in claim 5 wherein said first dielectric housing retention means is comprised of an inwardly directed lip which extends around one end of said conductive shell member to secure said first dielectric housing member in said shell member.

9. The electrical connector as described in claim 5 wherein said second dielectric housing retention means is comprised of an interference fit between the exterior surface of said second dielectric housing member and the interior surface of said conductive shell member.

10. A method of making a filtered electrical connector for connection with a complementary electrical connector, comprising the steps of:

securing and electrically coupling filter means in a conductive transverse wall, so as to define a grounding means; said wall being unitary with a conductive shell member and having a plurality of first passageways extending therethrough for receiving said filter means therein, said filter means having bores extending axially therethrough for engaging electrical terminal means;

positioning a dielectric housing member having a plurality of second passageways therein within said conductive shell member, said second passageways being aligned with one end of said first passageways of said transverse wall;

disposing electrical terminal means into said aligned first and second passageways, said electrical terminal means being comprised of a contact section, a filter engaging section and a conductor securing section, said conductor securing section being electrically connectable to conductor means, said electrical terminal means being disposed in said first and second passageways such that said filter engaging portion engages said bores of said filter means and is in electrical engagement with said filter means and said conductor securing portion lies within said second passageway.

11. The method of making the filtered electrical connector as described in claim 10 further comprising the steps of:

positioning a second dielectric housing member having a plurality of third passageways therein, within said conductive shell member such that said third passageways are in alignment with a second end of said first passageways of said transverse wall with said contact sections of said electrical terminal means passing through said third passageways and extending therefrom.

12. The method of making the filtered electrical connector as described in claim 10 wherein said filter means are electrically coupled to said first passageways by means of a solder plate having a plurality of apertures therein, said apertures being in the same geometric array as said first passageways whereby upon positioning said solder plate over said filter means and in contact with said transverse wall and applying heat, the solder softens and flows to electrically couple said filter means to said first passageways.

13. The method of making the filtered electrical connector as described in claim 10 wherein said electrical terminal means is a plurality of pin terminals, the filter receiving section of each said pin terminal being comprised of a plurality of outwardly bowed spring elements for engaging said filter means.

14. The method of making the filtered electrical connector as described in claim 13 wherein said filter means is comprised of a tubular filter sleeve element disposed over said outwardly bowed spring elements on each said pin terminal.

* * * * *